US010957137B2

(12) United States Patent
Baumgarte et al.

(10) Patent No.: US 10,957,137 B2
(45) Date of Patent: Mar. 23, 2021

(54) SYSTEMS AND METHODS FOR DISCOURAGING TAILGATING

(71) Applicant: Schlage Lock Company LLC, Carmel, IN (US)

(72) Inventors: Joseph W. Baumgarte, Carmel, IN (US); Andrew Setter, Carmel, IN (US); Lee Odess, Bethesda, MD (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 16/576,901

(22) Filed: Sep. 20, 2019

(65) Prior Publication Data

US 2020/0098211 A1 Mar. 26, 2020

Related U.S. Application Data

(60) Provisional application No. 62/733,964, filed on Sep. 20, 2018.

(51) Int. Cl.

| | |
|---|---|
| ***G07C 9/15*** | (2020.01) |
| ***G07C 9/28*** | (2020.01) |
| ***G08B 7/06*** | (2006.01) |
| ***G08B 21/22*** | (2006.01) |
| ***G07C 9/00*** | (2020.01) |
| ***G07C 9/20*** | (2020.01) |

(52) U.S. Cl.
CPC ..... *G07C 9/28* (2020.01); *G07C 9/00* (2013.01); *G07C 9/15* (2020.01); *G07C 9/20* (2020.01); *G08B 7/06* (2013.01); *G08B 21/22* (2013.01)

(58) Field of Classification Search
CPC ..... G07C 9/00; G07C 9/15; G07C 9/20
See application file for complete search history.

(56) References Cited

U.S. PATENT DOCUMENTS

| | | | | |
|---|---|---|---|---|
| 2002/0067259 | A1* | 6/2002 | Fufidio | G08B 13/183 340/541 |
| 2007/0268145 | A1* | 11/2007 | Bazakos | G07C 9/28 340/573.1 |
| 2009/0152352 | A1* | 6/2009 | Hemmer | G06K 7/10207 235/439 |

* cited by examiner

*Primary Examiner* — Benyam Haile
(74) *Attorney, Agent, or Firm* — Taft Stettinius & Hollister LLP

(57) ABSTRACT

An exemplary apparatus includes a sensor, control circuitry, and an alert mechanism. The sensor is configured to sense one or more users entering a passageway. The control circuitry in communication with the sensor and a credential reader, and is configured to count a number of the one or more users entering the passageway, to count a number of authorized credentials presented to the credential reader, and to transmit an alert signal based upon the number of the one or more users and the number of authorized credentials. The alert mechanism in communication with the control circuitry, and is configured to perform an alert operation in response to the alert signal.

17 Claims, 4 Drawing Sheets

SYSTEMS AND METHODS FOR DISCOURAGING TAILGATING

CROSS-REFERENCE TO RELATED APPLICATIONS

The present application claims the benefit of U.S. Provisional Patent Application No. 62/733,964 filed Sep. 20, 2018, the contents of which are incorporated herein by reference in their entirety.

TECHNICAL FIELD

The present disclosure generally relates to access control systems, and more particularly but not exclusively relates to systems and methods for discouraging individuals from entering a secured area without presenting an authorized credential.

BACKGROUND

In many access control systems, a movable barrier such as a door or gate defines a boundary between a secured area and an unsecured area, and operation of the barrier is controlled at least in part by a credential reader. While it is often desirable to ensure that each person entering the secured area is authorized to do so, certain conventional access control systems are vulnerable to an act often referred to as tailgating. In the typical tailgating scenario, a first person presents an authorized credential to unlock or open the door, and a second person enters through the open door without presenting his or her own authorized credential. The prevalence of this scenario may be partially attributed to societal norms, under which it may be considered rude to fail to hold the door for an approaching person, even one of unknown identity. This scenario can be particularly common in workplaces, where the approaching person is presumably a colleague. For these reasons among others, there remains a need for further improvements in this technological field.

SUMMARY

An exemplary apparatus includes a sensor, control circuitry, and an alert mechanism. The sensor is configured to sense one or more users entering a passageway. The control circuitry in communication with the sensor and a credential reader, and is configured to count a number of the one or more users entering the passageway, to count a number of authorized credentials presented to the credential reader, and to transmit an alert signal based upon the number of the one or more users and the number of authorized credentials. The alert mechanism in communication with the control circuitry, and is configured to perform an alert operation in response to the alert signal. Further embodiments, forms, features, and aspects of the present application shall become apparent from the description and figures provided herewith.

DETAILED DESCRIPTION OF ILLUSTRATIVE EMBODIMENTS

Figure 1:
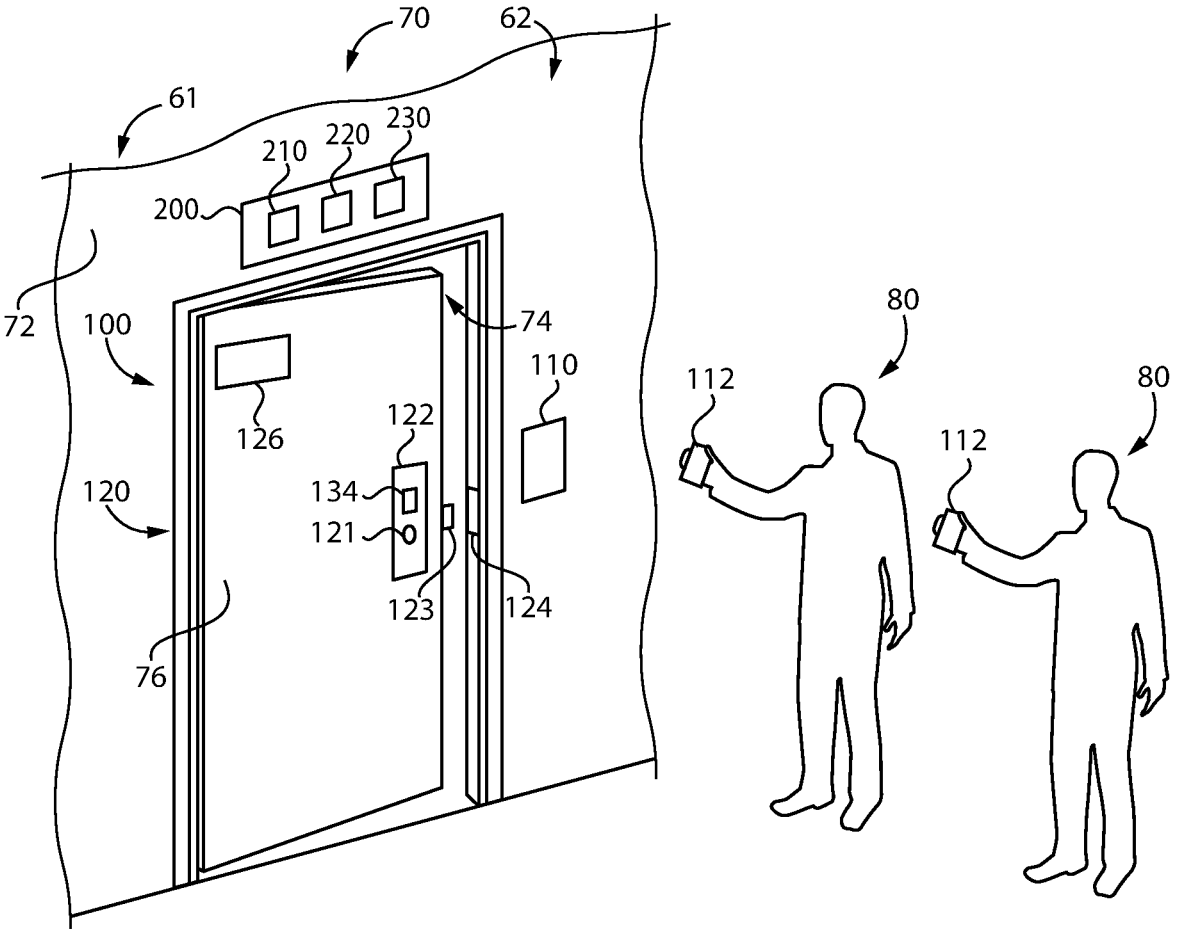
FIG. 1 illustrates a system according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

With reference to FIG. 1, illustrated therein is an access assembly 70 that defines a boundary between a more-secure area or secured region 61 and a less-secure area or unsecured region 62. The access assembly 70 includes a wall 72 having a passageway 74 formed therethrough, and in the illustrated form further includes a movable barrier 76 that selectively prevents passage of users through the passageway 74. The access assembly 70 also includes an access control system 100 that controls operation of the barrier 76 to selectively allow passage of persons 80 from the unsecured region 62 to the secured region 61. While the illustrated barrier 76 is provided in the form of a door, it is also contemplated that the barrier 76 may take another form, such as that of a gate. As described herein, it is also contemplated that the barrier 76 may be omitted, and access through the passageway 74 may be controlled by the access control system 100 in another manner.

In the illustrated form, the access control system 100 includes a credential reader 110, a barrier control device 120 in communication with the credential reader 110, and a barrier state sensor 130 operable to sense a state of the barrier 76. In certain embodiments, the barrier control device 120 and/or the barrier state sensor 130 may be omitted from the access control system 100, such as in embodiments in which the barrier 76 is omitted from the access assembly 70.

The credential reader 110 is configured to read a user credential 112, and to determine whether the user credential 112 is an authorized credential corresponding to a user 80 that is authorized to access the secured region 61. While the illustrated credential reader 110 is mounted to the wall 72, it is to be appreciated that other mounting locations are contemplated. For example, the credential reader 110 may be embedded in the wall 72 or the doorframe such that the reader 110 is not immediately apparent to the eye. In certain forms, the user credential 112 may be embodied on a card or chip, such as a magnetic card, radio frequency identification (RFID) circuitry, or a near field communication (NFC) card, and the credential reader 110 may be configured to read such user credentials. Additionally or alternatively, the user credential 112 may be stored on a mobile device configured to transmit the user credential 112 to the credential reader. In certain embodiments, the credential reader 110 may be a biometric credential reader such as a fingerprint scanner or an iris recognition device, and the user credential 112 may be a corresponding biometric credential. In other forms, the credential reader 110 may comprise a keypad and the user may input a user credential 112 in the form of a personal identification number or a password using the keypad. While certain examples have been given for the credential reader 110 and the credential, it is to be appreciated that such examples are illustrative only and are non-limiting in nature.

The barrier control device 120 selectively retains the barrier 76 in an access-preventing state in which the barrier 76 prevents passage of the users 80 through the passageway 74. For example, the barrier 76 in the access-preventing state may be closed and locked. When an authorized credential is presented to the credential reader 110, the barrier control device 120 transitions the barrier 76 to an access-permitting state in which the barrier 76 permits passage of the users 80 through the passageway. For example, the barrier 76 in the access-permitting state may be open and/or unlocked.

In certain embodiments, the barrier control device 120 may include an electrified lockset 122, which may or may not necessarily include the credential reader 110. In such forms, transitioning the barrier 76 from the access-preventing state to the access-permitting state may involve placing the lockset 122 in an unlocked state such that a user can actuate a handle 121 to retract a latchbolt 123. In certain embodiments, the barrier control device 120 may include an electric strike 124. In such forms, transitioning the barrier 76 from the access-preventing state to the access-permitting state may involve placing the electric strike 124 in an unlocked state in which the barrier 76 can be opened without retracting the latchbolt 123. In certain embodiments, the barrier control device 120 may include a powered barrier operator 126. In such forms, transitioning the barrier 76 from the access-preventing state to the access-permitting state may involve powering the barrier operator 126 to move the barrier 76 from a closed position to an open position. While certain exemplary forms of the barrier control device 120 have been provided, it is to be appreciated that other forms of barrier control device 120 may be utilized to selectively retain the barrier 76 in a closed and locked position.

The barrier state sensor 130 is configured to sense a state of the barrier 76, for example to aid in determining whether the barrier 76 is in an access-permitting state or an access-preventing state. The barrier state sensor 130 may, for example, include a barrier position sensor 132 (FIG. 2) configured to sense the open/closed position of the barrier 76. Additionally or alternatively, the barrier state sensor 130 may include a request to exit sensor 134 configured to sense whether a person is actuating the lockset 122 in an attempt to move the barrier 76 toward the open position.

Also illustrated in FIG. 1 is a tailgate-discouraging device 200 according to certain embodiments. The device 200 is in communication with the access control system 100, and is configured to discourage tailgating through the access assembly 70. In certain embodiments, the access control system 100 may be considered to include the device 200.

Figure 2:
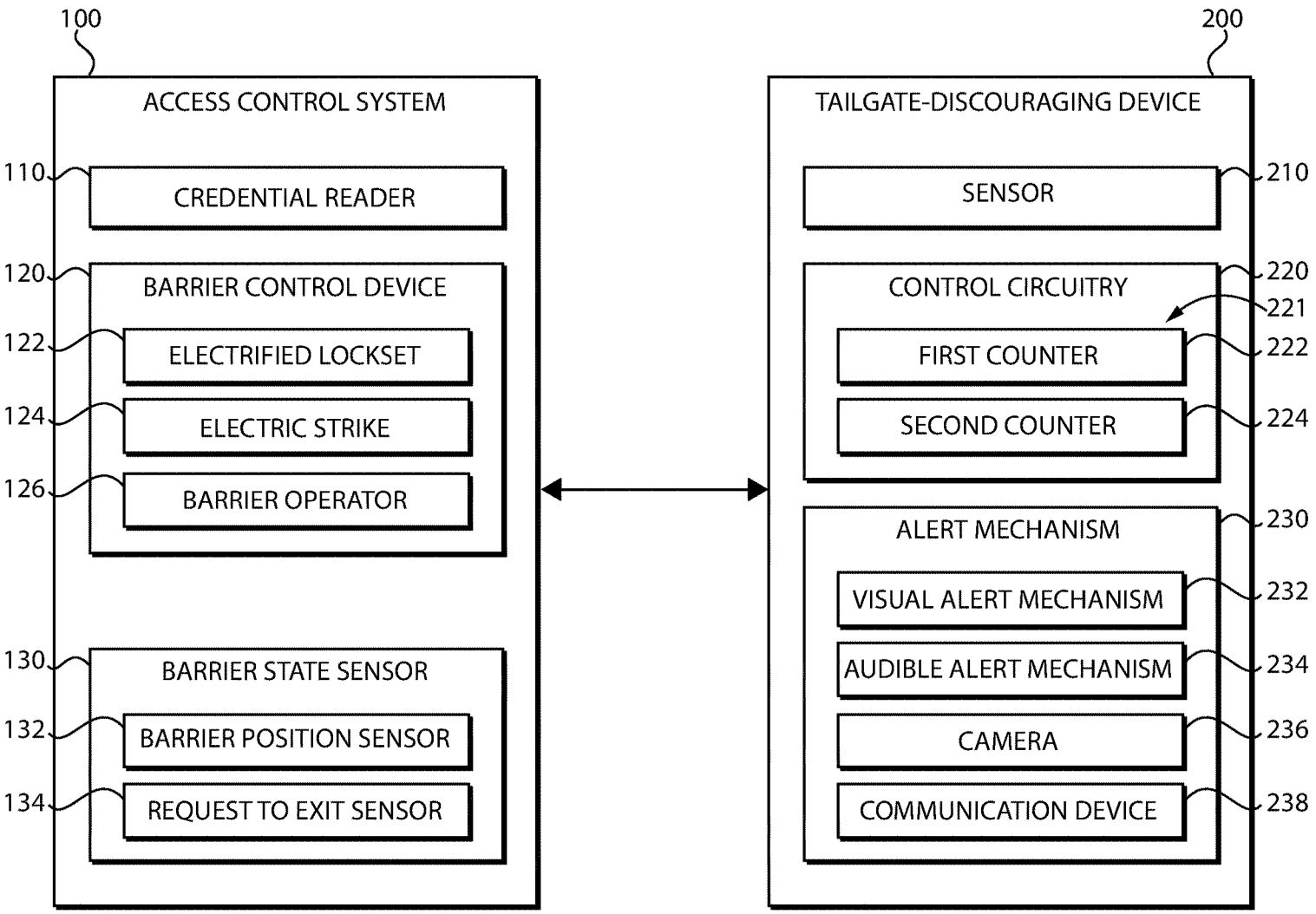
FIG. 2 is a schematic block diagram of the system illustrated in FIG. 1.

With additional reference to FIG. 2, the device 200 generally includes a sensor 210, control circuitry 220 in communication with the sensor 210, and an alert mechanism 230 controlled by the control circuitry 220. As described herein, the device 200 is generally configured to compare the number of users 80 entering the passageway 74 with the number of authorized credentials presented to the credential reader 110, and to trigger an alert when the number of users $N_{user}$ exceeds the number of authorized credentials $N_{auth}$.

The sensor 210 is configured to sense the number of users entering the passageway 74. The sensor 210 may, for example, comprise a motion sensor, an infrared sensor, a time-of-flight sensor, or another form of sensor configured to count the number of users entering the passageway 74. Such person-counting sensors 210 are known in the art, and need not be described in further detail herein.

The control circuitry 220 is in communication with the sensor 210 and the alert mechanism 230, and includes one or more counters 221. More particularly, the control circuitry 220 includes a first counter 222, and may further include a second counter 224. As described herein, the control circuitry 220 is configured to manipulate the one or more counters 221 based on information received from the access control system 100 and the sensor 210, and to trigger or activate the alert mechanism 230 based upon the one or more counters 221. More particularly, the control circuitry 220 is configured to trigger an alert when the counter(s) 221 indicate that the number of persons attempting to enter the passageway 74 exceeds the number of authorized credentials presented to the credential reader 110.

The alert mechanism 230, when activated by the control circuitry 220, provides an alert that indicates that one or more of the users 80 has not presented an authorized user credential 112 to the credential reader 110. The alert mechanism may, for example, be configured to provide the alert to the users 80 themselves, and/or to one or more additional or alternative parties, such as security personnel at a remote security station. The alert mechanism 230 may include one or more of a visual alert mechanism 232, an audible alert mechanism 234, a camera 236, and/or a communication device 238.

In certain embodiments, the alert mechanism 230 may include a visual alert mechanism 232 configured to provide a visual alert, such as a flashing light. Additionally or alternatively, the alert mechanism 230 may comprise an audible alert mechanism 234 configured to provide an audible alert, such as a chime or spoken message. Such audible and/or visual alerts may serve as reminder to the users 80 that tailgating (i.e., following another user through the passageway without presenting one's own credential) is not permitted.

In certain embodiments, the alert mechanism 230 may include a camera 236 configured to take a picture of the user(s) 80 whose entry into the passageway 74 caused the alert to be triggered. In certain embodiments, the alert mechanism 230 may include a communication device 238 configured to provide the alert in the form of a wired or wireless message, such as a text message, an email, or another form of message. For example, the communication device 238 may be configured to transmit a signal to a manned access control station, thereby alerting security personnel that a tailgating attempt has occurred at a particular passageway 74 in the facility. Such a signal may activate the camera 236, include a photo taken by the camera 236, or indicate to the security personnel which of a plurality of displays corresponds to the camera 236 such that the security personnel can quickly view the area in which the tailgating is occurring.

Figure 3:
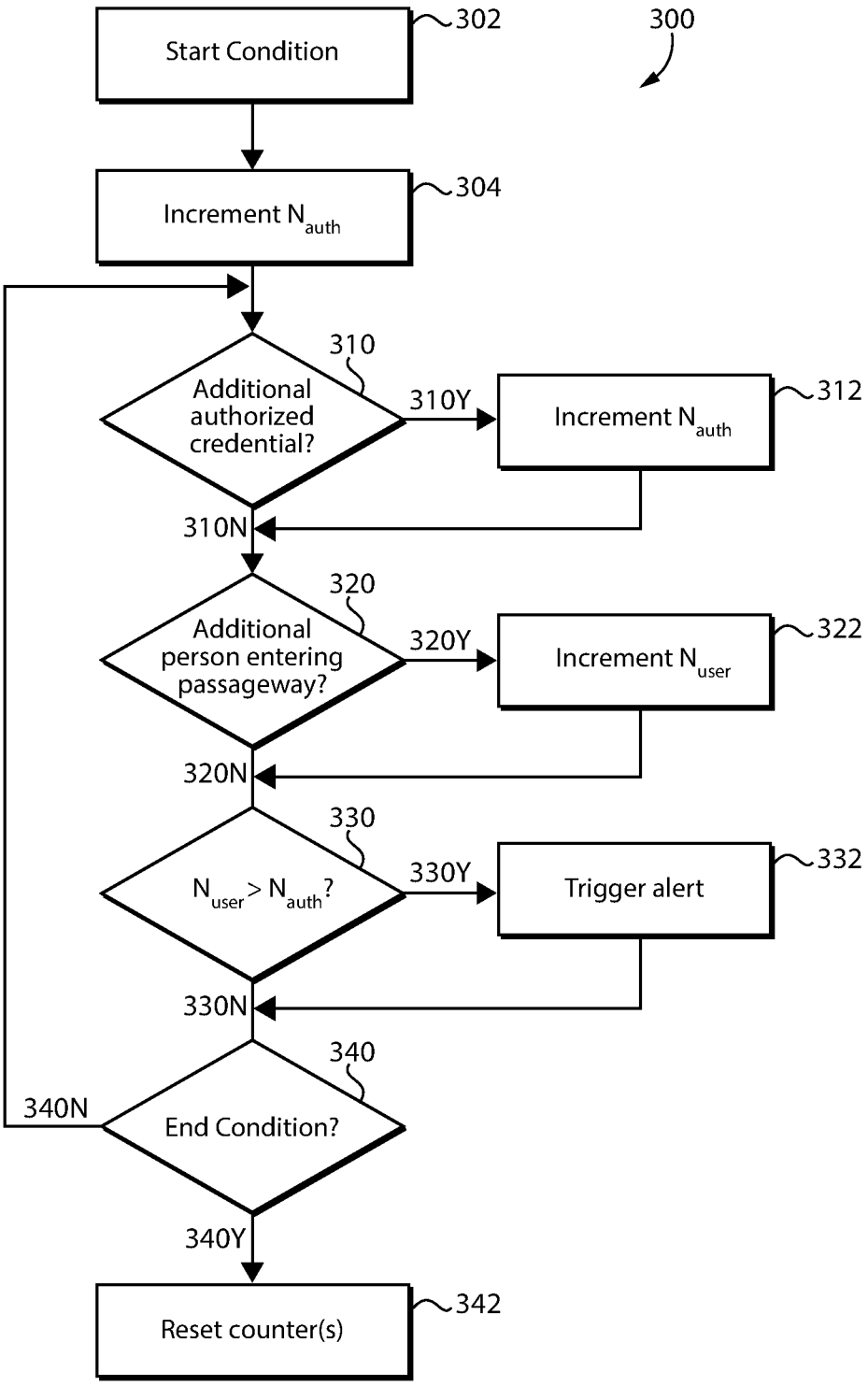
FIG. 3 is a schematic flow diagram of a process according to certain embodiments.

With additional reference to FIG. 3, illustrated therein is a process 300 according to certain embodiments. It should be appreciated that the particular blocks of the process 300 are illustrated by way of example, and such blocks may be combined or divided, added or removed, and/or reordered in whole or in part depending on the particular embodiment, unless stated to the contrary. Furthermore, while the blocks are illustrated in a generally sequential order, it is also contemplated that two or more of the blocks may be performed contemporaneously.

The example process 300 may begin at block 302, in which a start condition is received at the control circuitry 220. Block 302 may include waking the control circuitry from a sleep mode. In embodiments that include the barrier 76, the start condition may indicate that an open/close cycle for the barrier 76 is about to begin or has begun. The start condition may, for example, be provided when an authorized credential is presented to the credential reader 110 for the first time following the completion of a prior open/close cycle, or when an authorized credential is presented to the credential reader 110 while the barrier 76 is in the access-preventing state.

In certain embodiments, the start condition may be based at least in part upon a signal received from the credential reader 110, wherein the signal is indicative of an authorized credential having been presented to the credential reader 110. Additionally or alternatively, the start condition may be based at least in part upon signals received from the barrier state sensor 130. For example, the start condition may be based in part upon a signal from the barrier position sensor 132, wherein the signal is indicative of the barrier 76 moving from the closed position to the open position. As another example, the start condition may be based in part upon a signal from the request to enter sensor 134, where the signal is indicative of a person successfully operating the barrier control device 120 such that the barrier 76 is in the access-permitting state.

In certain embodiments, the start condition may not necessarily be related to the start of an open/close cycle for the barrier 76. For example, the device 200 may enter a sleep mode when the circuitry 220 has not received new information from the access control system 100 and/or the sensor 210 for a predetermined amount of time. In such forms, the start condition may take the form of new information being received at the control circuitry 220 when the control circuitry 220 is in the sleep mode.

In certain forms, the start condition may be indicative of a user having presented an authorized credential to the credential reader 110. For example, in embodiments in which the start condition is based at least in part upon an authorized credential being presented to the credential reader 110, the start condition is directly indicative of an authorized credential having been presented to the credential reader 110. As another example, in embodiments in which the start condition is based at least in part upon the barrier position sensor 132, the start condition may be indirectly indicative of an authorized credential having been presented to the credential reader 110, as the barrier 76 moves to the open position only after an authorized credential has been presented to the credential reader 110.

The process 300 generally involves tracking the number of authorized credentials $N_{auth}$ (i.e., the number of user credentials that are presented to the credential reader 110 and determined to be authorized credentials) and the number of entering users $N_{user}$ (i.e., the number of users 80 attempting to enter the passageway 74). This tracking may be performed at least in part by the one or more counters 221. As described herein, tracking the authorized credential number $N_{auth}$ may involve manipulating the at least one counter 221 in a first manner, such as by incrementing or decrementing one or more counters, and tracking the user number $N_{user}$ may involve manipulating the at least one counter 221 in a second manner, such as by incrementing or decrementing one or more counters.

In certain embodiments, the authorized credential number $N_{auth}$ and the user number $N_{user}$ may be tracked individually. For example, a first counter 222 may track the authorized credential number $N_{auth}$ and a second counter 224 may track the user number $N_{user}$. In such forms, the control circuitry 220 may increment the first counter 222 each time an additional authorized credential is presented to the credential reader, and increment the second counter 224 each time an additional user is sensed entering the passageway 74. Thus, manipulating the at least one counter 221 in the first manner to track the authorized credential number $N_{auth}$ may involve incrementing the first counter 222, and manipulating the at least one counter 221 in the second manner to track the user number $N_{user}$ may involve incrementing the second counter 224

In other embodiments, the authorized credential number $N_{auth}$ and the user number $N_{user}$ may be tracked collectively. For example, the second counter 224 may be omitted, and a single counter 222 may track both the authorized credential number $N_{auth}$ and the user number $N_{user}$. In such forms, the control circuitry 220 may increment the single counter 222 each time an additional authorized credential is presented to the credential reader, and decrement the single counter 222 each time an additional user is sensed entering the passageway 74. Alternatively, the control circuitry 220 may decrement the single counter 222 each time an additional authorized credential is presented to the credential reader, and increment the single counter 222 each time an additional user is sensed entering the passageway 74. Thus, manipulating the at least one counter 221 in the first manner to track the authorized credential number $N_{auth}$ may involve one of incrementing or decrementing the single counter 222, and manipulating the at least one counter 221 in the second manner to track the user number $N_{user}$ may involve the other of incrementing or decrementing the single counter 222.

As noted above, the start condition may be indicative of an authorized credential having been presented to the credential reader 110. In such forms, the process 300 may involve block 304, which involves incrementing the counted number of authorized credentials $N_{auth}$ by manipulating the at least one counter 221 in the first manner. In other embodiments, the start condition may not necessarily be indicative of an authorized credential having been presented to the credential reader. For example, the start condition may be indicative of a user 80 attempting to enter the passageway without having first presented an authorized credential. In such forms, block 304 may be omitted, and the process 300 may proceed to block 310 in response to the start condition having been satisfied.

The process 300 includes block 310, which involves determining whether an additional authorized credential has been presented to the credential reader 110. The analysis of block 310 may be based on information received from the access control system 100, such as information received directly or indirectly from the credential reader 110. If the result of block 310 is positive 310Y, the process 300 proceeds to block 312, which involves incrementing the counted number of authorized credentials $N_{auth}$ by manipulating the at least one counter 221 in the first manner. If the result of block 310 is negative 310N, the process 300 may continue to block 320.

Block 320 generally involves determining whether an additional user has attempted to enter the passageway 74. The analysis of block 320 may be based upon information received from the sensor 210. If the result of block 320 is negative 320N, the process 300 may continue to block 330. If the result of block 320 is positive 320Y, the process 300 proceeds to block 322, which involves incrementing the counted number of users $N_{user}$ by manipulating the at least one counter 221 in the second manner.

Block 330 generally involves determining whether or not to trigger an alert based upon the counted number of users $N_{user}$ and the counted number of authorized credentials $N_{auth}$. More particularly, block 330 involves determining to trigger the alert if the number of users entering the passageway $N_{user}$ exceeds the number of authorized credentials $N_{auth}$. The analysis of block 330 may involve determining to trigger the alert in response to the at least one counter 221 having a predetermined state. For example, in embodiments in which the at least one counter 221 includes a first counter 222 for tracking the authorized credential number $N_{auth}$ and a second counter 224 for tracking the user number $N_{user}$, the predetermined state may comprise the number tracked by the second counter 224 exceeding the number tracked by the first counter 222.

In embodiments in which the at least one counter 221 includes a single counter 222, the predetermined state of the at least one counter 221 may involve the single counter reaching a threshold value. For example, in embodiments in which the control circuitry increments the single counter 222 to track the authorized credential number $N_{auth}$ and decrements the single counter 222 to track the user number $N_{user}$, the threshold value may be negative one, as such a value indicates that more users have attempted to enter the passageway than have presented an authorized credential. Similarly, in embodiments in which the control circuitry decrements the single counter 222 to track the authorized credential number $N_{auth}$ and increments the single counter 222 to track the user number $N_{user}$, the threshold value may be positive one, as such a value indicates that more users have attempted to enter the passageway than have presented an authorized credential.

If the result of block 330 is negative 330N, the process 300 may continue to block 340. In response to a positive result 330Y at block 330, the process 300 continues to block 332, which generally involves triggering an alert. Block 332 may, for example, include the control circuitry 220 transmitting an alert signal to the alert mechanism 230. In response to receiving the alert signal, the alert mechanism 230 emits an audible or visual alert. In embodiments in which the alert mechanism 230 includes the visual alert mechanism 232, block 332 may involve emitting a visual alert, such as by flashing a light. In embodiments in which the alert mechanism 230 includes the audible alert mechanism 234, block 332 may involve emitting an audible alert, such as by sounding a chime or playing a prerecorded voice message. In embodiments in which the alert mechanism 230 includes the camera 236, block 332 may involve photographing the one or more users entering the passageway 74. In embodiments in which the alert mechanism 230 includes the communication device 238, block 332 may involve transmitting an alert signal to a remote location. The process 300 may then continue to block 340.

Block 340 generally involves determining whether an end condition has occurred. In certain embodiments, the end condition may be indicative of the open/close cycle of the barrier 76 having come to an end. In such forms, the determining of block 340 may be based at least in part upon information received from the barrier condition sensor 130. As one example, block 340 may involve determining the presence of the end condition when the barrier position sensor 134 indicates that the barrier 76 has moved from the open position to the closed position. In other embodiments, the end condition may be determined to occur when the control circuitry 220 has not received new information from the access control system 100 and/or the sensor 210 for a predetermined period of time. If the result of block 340 is negative 340N, the process 300 may return to block 310. If the result of block 340 is positive 340Y, the process 300 may continue to block 342.

Block 342 generally involves resetting the at least one counter 221 in response to the end condition. In embodiments in which the at least one counter 221 includes a single counter 222, block 342 may involve resetting the single counter 222 to zero or another predetermined value. In embodiments in which the at least one counter 221 includes two counters 222, 224 block 342 may involve resetting each of the counters 222, 224 to zero or another predetermined value. Block 342 may further involve placing the control circuitry 220 in a sleep mode, for example in embodiments in which such a sleep mode is utilized.

Figure 4:
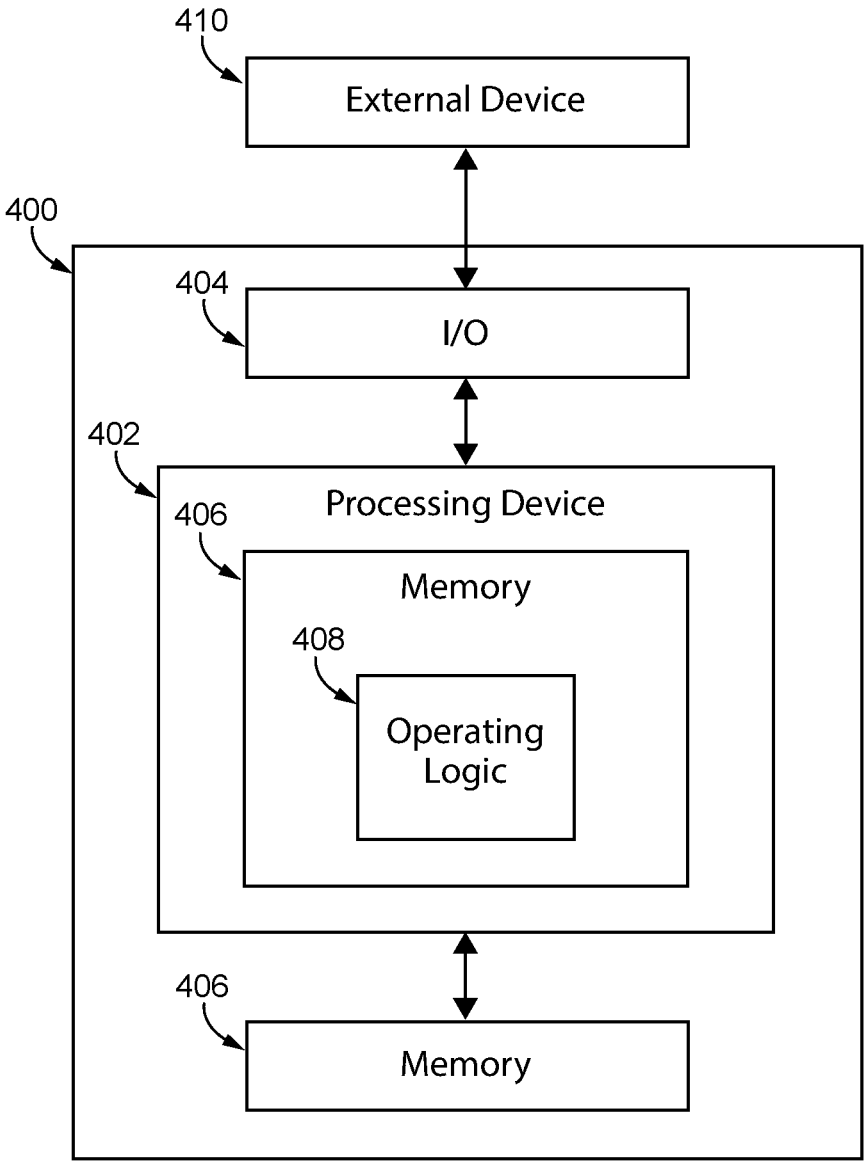
FIG. 4 is a schematic block diagram of a computing device.

Referring now to FIG. 4, a simplified block diagram of at least one embodiment of a computing device 400 is shown. The illustrative computing device 400 depicts at least one embodiment of a credential reader 110, barrier control device 120, barrier state sensor 130, sensor 210, control circuitry 220, or alert mechanism 230 that may be utilized in connection with the system illustrated in FIGS. 1 and 2, and which may be utilized in performing the process 300 illustrated in FIG. 3.

Depending on the particular embodiment, the computing device 400 may be embodied as a server, desktop computer, laptop computer, tablet computer, notebook, netbook, Ultrabook™ mobile computing device, cellular phone, smartphone, wearable computing device, personal digital assistant, Internet of Things (IoT) device, reader device, access control device, control panel, processing system, router, gateway, and/or any other computing, processing, and/or communication device capable of performing the functions described herein.

The computing device 400 includes a processing device 402 that executes algorithms and/or processes data in accordance with operating logic 408, an input/output device 404 that enables communication between the computing device 400 and one or more external devices 410, and memory 406 which stores, for example, data received from the external device 410 via the input/output device 404.

The input/output device 404 allows the computing device 400 to communicate with the external device 410. For example, the input/output device 404 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), Wi-Fi®, WiMAX, etc.) to effect such communication depending on the particular computing device 400. The input/output device 404 may include hardware, software, and/or firmware suitable for performing the techniques described herein.

The external device 410 may be any type of device that allows data to be inputted or outputted from the computing device 400. For example, in various embodiments, the external device 410 may be embodied as credential reader 110, barrier control device 120, barrier state sensor 130, sensor 210, control circuitry 220, and/or the alert mechanism 230. Further, in some embodiments, the external device 410 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 410 may be integrated into the computing device 400.

The processing device 402 may be embodied as any type of processor(s) capable of performing the functions described herein. In particular, the processing device 402 may be embodied as one or more single or multi-core processors, microcontrollers, or other processor or processing/controlling circuits. For example, in some embodiments, the processing device 402 may include or be embodied as an arithmetic logic unit (ALU), central processing unit (CPU), digital signal processor (DSP), and/or another suitable processor(s). The processing device 402 may be a programmable type, a dedicated hardwired state machine, or a combination thereof. Processing devices 402 with multiple processing units may utilize distributed, pipelined, and/or parallel processing in various embodiments. Further, the processing device 402 may be dedicated to performance of just the operations described herein, or may be utilized in one or more additional applications. In the illustrative embodiment, the processing device 402 is of a programmable variety that executes algorithms and/or processes data in accordance with operating logic 408 as defined by programming instructions (such as software or firmware) stored in memory 406. Additionally or alternatively, the operating logic 408 for processing device 402 may be at least partially defined by hardwired logic or other hardware. Further, the processing device 402 may include one or more components of any type suitable to process the signals received from input/output device 404 or from other components or devices and to provide desired output signals. Such components may include digital circuitry, analog circuitry, or a combination thereof.

The memory 406 may be of one or more types of non-transitory computer-readable media, such as a solid-state memory, electromagnetic memory, optical memory, or a combination thereof. Furthermore, the memory 406 may be volatile and/or nonvolatile and, in some embodiments, some or all of the memory 406 may be of a portable variety, such as a disk, tape, memory stick, cartridge, and/or other suitable portable memory. In operation, the memory 406 may store various data and software used during operation of the computing device 400 such as operating systems, applications, programs, libraries, and drivers. It should be appreciated that the memory 406 may store data that is manipulated by the operating logic 408 of processing device 402, such as, for example, data representative of signals received from and/or sent to the input/output device 404 in addition to or in lieu of storing programming instructions defining operating logic 408. As illustrated, the memory 406 may be included with the processing device 402 and/or coupled to the processing device 402 depending on the particular embodiment. For example, in some embodiments, the processing device 402, the memory 406, and/or other components of the computing device 400 may form a portion of a system-on-a-chip (SoC) and be incorporated on a single integrated circuit chip.

In some embodiments, various components of the computing device 400 (e.g., the processing device 402 and the memory 406) may be communicatively coupled via an input/output subsystem, which may be embodied as circuitry and/or components to facilitate input/output operations with the processing device 402, the memory 406, and other components of the computing device 400. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 400 may include other or additional components, such as those commonly found in a typical computing device (e.g., various input/output devices and/or other components), in other embodiments. It should be further appreciated that one or more of the components of the computing device 400 described herein may be distributed across multiple computing devices. In other words, the techniques described herein may be employed by a computing system that includes one or more computing devices. Additionally, although only a single processing device 402, I/O device 404, and memory 406 are illustratively shown in FIG. 4, it should be appreciated that a particular computing device 400 may include multiple processing devices 402, I/O devices 404, and/or memories 406 in other embodiments. Further, in some embodiments, more than one external device 410 may be in communication with the computing device 400.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system configured to be installed to an access assembly including a passageway, the system comprising:

a credential reader configured to read user credentials presented to the credential reader, wherein the credential reader is positioned on an entry side of the passageway;

a sensor positioned on the entry side of the passageway and configured to sense one or more persons entering the passageway from the entry side of the passageway;

control circuitry comprising at least one counter, wherein the control circuitry is configured to:

count a number of authorized credentials presented to the credential reader based upon information received from the credential reader;

count a number of persons entering the passageway based upon information received from the sensor;

selectively trigger an alert based upon the number of persons entering the passageway and the number of authorized credentials presented to the credential reader; and reset the at least one counter in response to an end condition comprising a lack of activity of the at least one counter for a predetermined period of time; and an alert mechanism in communication with the control circuitry, wherein the alert mechanism is configured to provide the alert when triggered by the control circuitry;

wherein the alert mechanism comprises a camera configured to capture an image of one or more persons whose presence triggered the alert;

wherein the control circuitry is configured to transmit the image to a remote location; and wherein the alert mechanism further comprises a communication device and is configured to transmit a message to the remote location when triggered by the control circuitry, and wherein the message includes information relating to a display on which the image is displayed.

2. The system of claim 1, wherein the access assembly further comprises a harrier movably positioned in the passageway;

wherein the system further comprises a barrier-control device configured to selectively retain the barrier in an access-preventing state; and wherein the barrier control device is configured to selectively place the barrier in an access-permitting state in response to a determination that a presented user credential is an authorized credential.

3. The system of claim 2, wherein the barrier control device comprises at least one of (i) an electrified lockset, (ii) an electric strike, and (iii) a powered barrier operator.

4. The system of claim 2, further comprising a barrier state sensor, wherein the end condition further comprises the barrier transitioning from the access-permitting state to the access-preventing state.

5. The system of claim 1, wherein the control circuitry is configured to adjust the at least one counter in a first manner to count the number of authorized credentials presented to the credential reader;

wherein the control circuitry is configured to adjust the at least one counter in a second manner to count the number of persons entering the passageway; and wherein the controller is configured to trigger the alert in response to a predetermined state of the at least one counter.

6. The system of claim 1, wherein the alert mechanism is configured to provide at least one of an audible alert or a visual alert when triggered by the control circuitry.

7. The system of claim 1, wherein the control circuitry is further configured to wake from a sleep mode in response to a start condition, and to enter the sleep mode in response to the end condition.

8. An apparatus, comprising:

a sensor configured to sense one or more users entering a passageway prior to the one or more users passing through the passageway;

control circuitry in communication with the sensor and a credential reader, wherein the control circuitry is configured to count a number of the one or more users entering the passageway, to count a number of authorized credentials presented to the credential reader, and to transmit an alert signal based upon the number of the one or more users and the number of authorized credentials; and an alert mechanism in communication with the control circuitry, wherein the alert mechanism is configured to perform an alert operation in response to the alert signal, wherein the alert mechanism comprises a camera configured to generate an image of the passageway in response to the alert signal, the image of the passageway comprising an image of one or more persons whose presence triggered the alert signal, and wherein the alert operation comprises transmitting the image of the passageway to a remote location; and wherein the alert mechanism comprises a communication device, and wherein performing the alert operation comprises transmitting a signal to the remote location, the signal indicating which display of a plurality of displays at the remote location is displaying the image of the passageway.

9. The apparatus of claim 8, wherein the control circuitry is configured to reset at least one counter in response to a signal indicating that a barrier associated with the passageway has moved from an access-permitting state to an access-preventing state.

10. An access assembly comprising the apparatus of claim 8, wherein the passageway is formed in a wall that defines a boundary between a secured region and an unsecured region; and wherein the apparatus is positioned in the unsecured region such that the sensor is operable to sense the one or more users when the one or more users are in the unsecured region.

11. The apparatus of claim 8, wherein the control circuitry is configured to reset the number of the one or more users entering the passageway and the number of authorized credentials presented to the credential reader in response to an end condition; and wherein the end condition comprises the number of the one or more users entering the passageway and the number of authorized credentials presented to the credential reader remaining unchanged for a predetermined period of time.

12. The apparatus of claim 8, wherein the control circuitry is further configured to wake from a sleep mode in response to a start condition, and to enter the sleep mode in response to an end condition.

13. The apparatus of claim 12, wherein the end condition comprises a lack of activity by the sensor and the credential reader for a predetermined period of time.

14. An access assembly, comprising:

a passageway, the passageway lacking a barrier operable to block passage through the passageway;

a credential reader configured to read user credentials presented to the credential reader;

a sensor configured to sense one or more persons entering the passageway;

control circuitry comprising at least one counter, wherein the control circuitry is configured to:

count a number of authorized credentials presented to the credential reader based upon information received from the credential reader;

count a number of persons entering the passageway based upon information received from the sensor; and selectively trigger an alert based upon the number of persons entering the passageway and the number of authorized credentials presented to the credential reader;

a camera in communication with the control circuitry, wherein the camera is configured to capture an image of one or more persons whose presence triggered the alert when triggered by the control circuitry; and a plurality of displays positioned at the remote location, wherein a particular display of the plurality of displays is configured to display information received from the camera;

wherein the control circuitry is further configured to transmit the image to a remote location; and wherein the control system is further configured to transmit to the remote location a signal identifying the particular display as displaying the image of the one or more persons whose presence triggered the alert.

15. The access assembly of claim 14, wherein the image is a still image.

16. The access assembly of claim 14, wherein the control circuitry is further configured to reset the at least one counter in response to a predetermined amount of time passing since last adjusting the at least one counter.

17. The access assembly of claim 14, wherein the control circuitry is further configured to enter a sleep mode in response to an end condition, and to exit from the sleep mode in response to a start condition;

wherein the end condition comprises a predetermined amount of time passing since last adjusting the at least one counter; and wherein the start condition comprises detection of activity via the sensor.

* * * * *